US007950445B2

(12) United States Patent
Cheng et al.

(10) Patent No.: US 7,950,445 B2
(45) Date of Patent: May 31, 2011

(54) COMBINED ASSEMBLY OF FIXING BASE AND HEAT PIPE

(75) Inventors: Chih-Hung Cheng, Wugu Township, Taipei County (TW); Ken Hsu, Wugu Township, Taipei County (TW)

(73) Assignees: Golden Sun News Techniques Co., Ltd., Taipei (TW); Cpumate Inc, Taipei (TW)

( * ) Notice: Subject to any disclaimer, the term of this patent is extended or adjusted under 35 U.S.C. 154(b) by 305 days.

(21) Appl. No.: 12/418,953

(22) Filed: Apr. 6, 2009

(65) Prior Publication Data

US 2009/0188657 A1 Jul. 30, 2009

Related U.S. Application Data

(63) Continuation-in-part of application No. 11/782,700, filed on Jul. 25, 2007, now abandoned.

(51) Int. Cl.
*H05K 7/20* (2006.01)

(52) U.S. Cl. ..... 165/80.2; 165/104.33; 165/80.3; 29/523; 361/700

(58) Field of Classification Search ..... None
See application file for complete search history.

(56) References Cited

U.S. PATENT DOCUMENTS 2,722,732 A * 11/1955 Sandberg ..... 29/890.038
3,432,916 A * 3/1969 Reichert et al. ..... 29/516
4,142,581 A * 3/1979 Yoshitomi et al. ..... 165/173
4,622,732 A * 11/1986 Broderick ..... 29/421.1
5,829,516 A * 11/1998 Lavochkin ..... 165/80.4
6,092,287 A * 7/2000 Thoms ..... 29/897.2
6,131,281 A * 10/2000 Morley ..... 29/890.03
6,853,555 B2 * 2/2005 Fichera et al. ..... 361/700
7,165,603 B2 * 1/2007 Mochizuki et al. ..... 165/104.21
7,245,494 B2 * 7/2007 Cheng ..... 361/700
2004/0035558 A1 * 2/2004 Todd et al. ..... 165/104.26

* cited by examiner

*Primary Examiner* — Allen J Flanigan
(74) *Attorney, Agent, or Firm* — Chun-Ming Shih; HDLS IPR Services

(57) ABSTRACT

A combined assembly of a fixing base and heat pipes includes a fixing base and at least one heat pipe. The fixing base has a plate body. The bottom surface of the plate body is formed with a transverse opening trough. The opening trough is provided with a through-hole penetrating the plate body. A longitudinal groove is provided in the opening trough at a position corresponding to that of the through-hole. One end of the longitudinal groove does not penetrate the plate body and is formed into a loose-proof section on the bottom section of the opening trough. The heat pipe has a heat-absorbing section and a heat-releasing section. The heat-releasing section penetrates to the outside of the through-hole, and the heat-absorbing section is accommodated in the opening trough. A portion of the heat-absorbing section is inserted into the longitudinal groove and stopped by the loose-proof section, and the other portion thereof is formed with a plane that is in flush with the bottom surface of the plate body. Via the above arrangement, the fixing base can be combined with the heat pipes firmly and tightly.

6 Claims, 7 Drawing Sheets

COMBINED ASSEMBLY OF FIXING BASE AND HEAT PIPE

This application is a continuation-in-part of U.S. patent application Ser. No. 11/782,700 filed on Jul. 25, 2007 now abandoned and thus claims the priority thereof.

BACKGROUND OF THE INVENTION

1. Field of the Invention

The present invention relates to a combined assembly of a fixing base and heat pipes, and in particular to a combined assembly for providing heat conduction for electronic elements.

2. Description of Prior Art

With respect to the heat conduction of electronic heat-generating elements, the industry nowadays utilizes heat pipes because of their high heat-transferring capacity, light weight, simple structure and versatility. The heat pipe can transfer a large amount of heat and thus is very suitable for meeting the demands for the heat conduction of the electronic products. The heat pipe is usually combined with a fixing base, thereby increasing the contact area between the heat pipe and the electronic heat-generating element efficiently. Therefore, whether the combination between the fixing base and the heat pipe is good or bad may affect the heat-transferring performance and the stability in fixation directly. Thus, it is an important issue in this art to enhance the firm combination and tight contact between the fixing base and the heat pipe.

Conventional combined assembly of the fixing base and the heat pipe includes a fixing base and a heat pipe. The fixing base has a plate body. The bottom surface of the plate body is formed with a rectangular opening trough. The heat pipe has an end to be heated and a heat-releasing section. The end to be heated is accommodated in the opening trough, and the heat-releasing section is formed above the plate body. A portion of the end to be heated abuts against and contacts the inner wall of the opening trough. With the above arrangement, the combined assembly of the fixing base and the heat pipe can be formed.

However, in practical use, the conventional combined assembly of the fixing base and the heat pipe still has the problem as follows. Since the left and right inner walls of the opening trough of the fixing base are vertical, the fixing force between the fixing base and the heat pipe after compression and combination is very small. As a result, the heat pipe and the fixing base can be detached from each other or get loosened due to the collision occurred during the assembling procedure (or during the process of combining with heat-dissipating pieces). Therefore, the heat-transferring performance and the stability in fixation are poor, and thus needs to be improved.

Further, as disclosed in U.S. Pat. No. 5,829,516, the bottom surface of a fixing base is provided with a semicircular opening trough. The width of the opening trough is smaller than the radius of the semi-circle. A heat pipe is embedded in the opening trough and then is subjected to a leveling process. Via this process, although the heat pipe can be retained therein, it is difficult to assure that the plane of the heat pipe and the bottom surface of the fixing base are located in the same plane. Thus, it is necessary to perform a secondary process such as grinding or milling to treat the combined assembly of the fixing base and the heat pipe. Since the angle formed between the bottom surface of the fixing base and the opening trough is acute, the edge of the acute angle may be flipped over or collapsed after the secondary process. As a result, not only the force for holding the heat pipes is reduced, but also the bottom surface of the combined assembly is uneven with crevices. Such unevenness and crevices may affect the heat transfer negatively, and thus needs to be improved.

SUMMARY OF THE INVENTION

The present invention is to provide a combined assembly of a fixing base and heat pipes. One end of the heat pipe is accommodated in an opening trough of the fixing base. A portion of the heat pipe is inserted into a longitudinal groove and stopped by a loose-proof section, so that the fixing base can be combined with the heat pipe more firmly.

The present invention is to provide a combined assembly of a fixing base and heat pipes, which includes a fixing base and at least one heat pipe. The fixing base has a plate body. The bottom surface of the plate body is formed with a transverse opening trough. The opening trough is provided with a through-hole penetrating the plate body. A longitudinal groove is provided in the opening trough at a position corresponding to that of the through-hole. One end of the longitudinal groove does not penetrate through the plate body and is formed into a loose-proof section on the bottom section of the opening trough. The heat pipe has a heat-absorbing section and a heat-releasing section. The heat-releasing section penetrates outside the through-hole of the fixing base, and the heat-absorbing section is accommodated in the opening trough. A portion of the heat-absorbing section is inserted into the longitudinal groove and stopped by the loose-proof section, and the other portion thereof is formed into a plane that is in flush with the bottom surface of the plate body.

The present invention is to provide a combined assembly of a fixing base and heat pipes. With the loose-proof section providing a strong stopping force for the heat pipe, the combined assembly can guarantee the stability in fixation between the fixing base and the heat pipe during the secondary process such as grinding the combined assembly or connecting the heat-dissipating pieces.

The present invention is to provide a combined assembly of a fixing base and heat pipes. With the loose-proof section being a rectangular block, the corner edge of the block will not be flipped over, collapsed and generate unevenness or crevices during the secondary process such as grinding or milling process. Thus, the heat-transferring performance and the stability in fixation of the heat pipe can be improved.

DETAILED DESCRIPTION OF THE INVENTION

Figure 1:
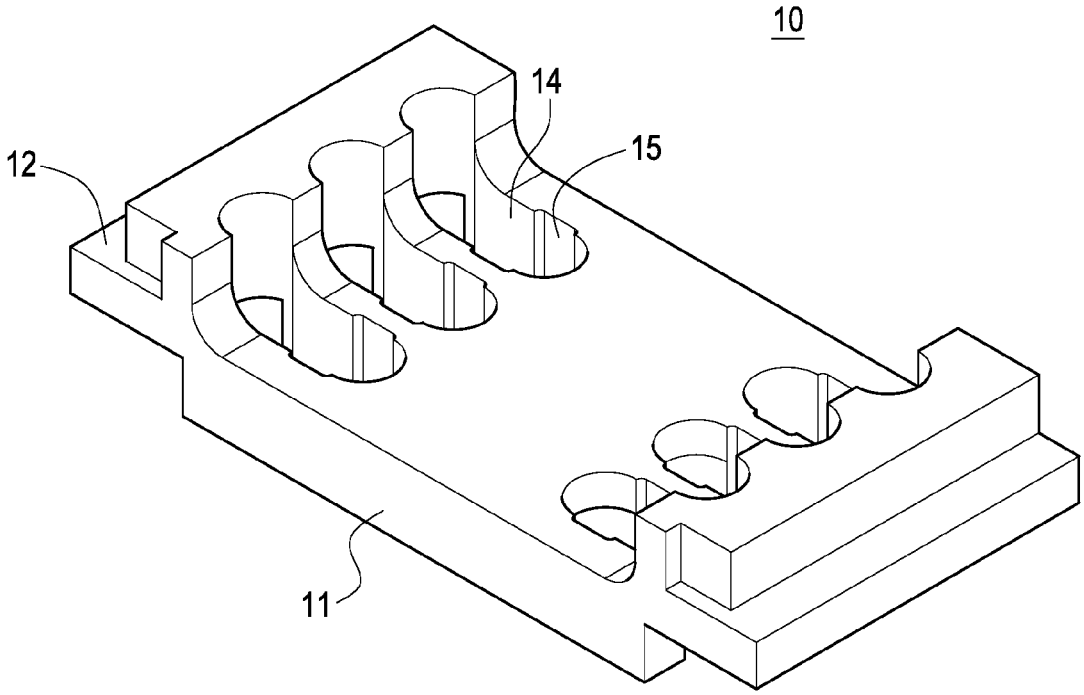
FIG. 1 is a perspective view showing the external appearance of the fixing base of the present invention.
Figure 2:
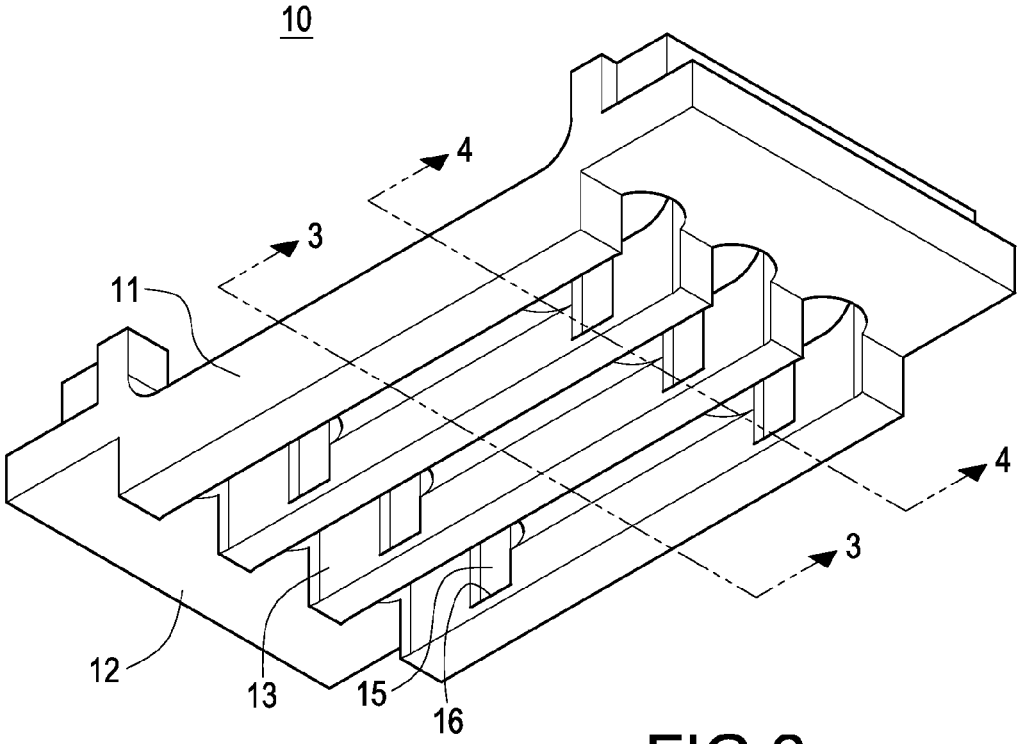
FIG. 2 is a perspective view showing the external appearance of the fixing base of the present invention taken from another viewing angle.
Figure 3:
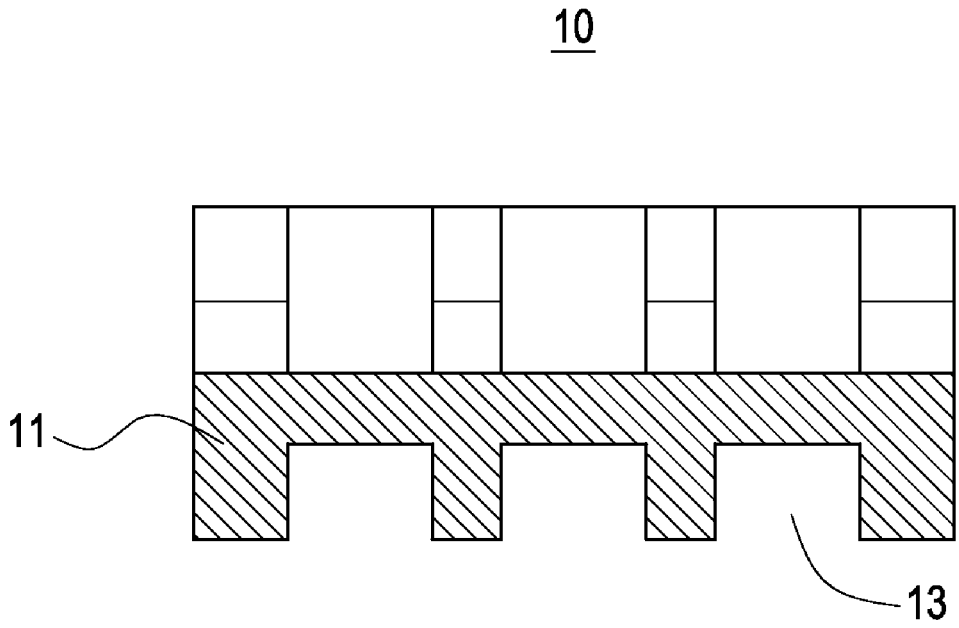
FIG. 3 is a cross-sectional view taken along the line 3-3 in FIG. 2.
Figure 4:
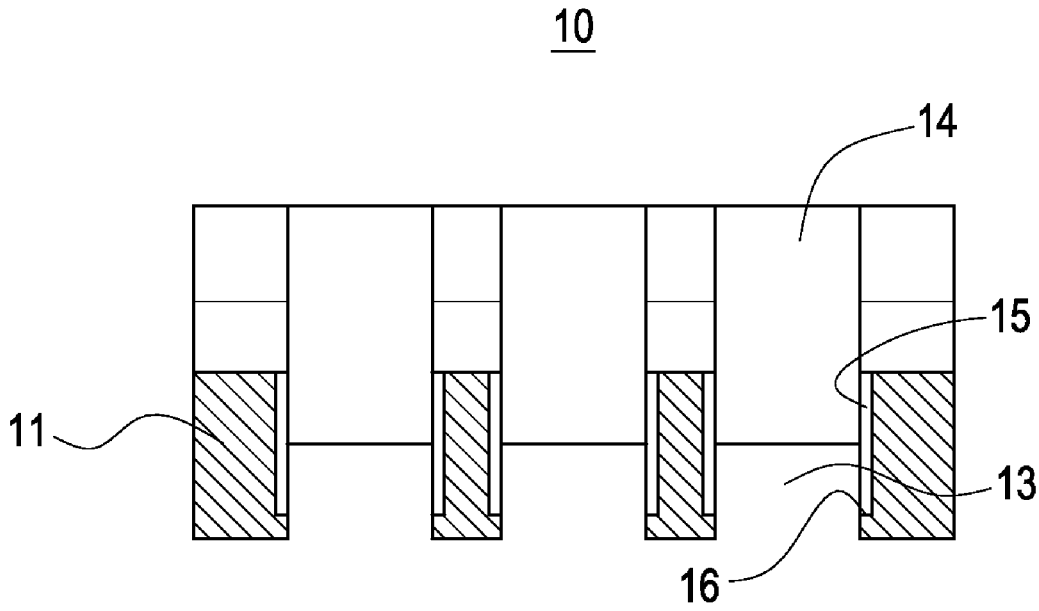
FIG. 4 is a cross-sectional view taken along the line 4-4 in FIG. 2.

The detailed description and the technical contents of the present invention will be made with reference to the accompanying drawings. However, it should be understood that the drawings are illustrative only, but not used to limit the present invention.

Please refer to FIGS. 1 to 4. The present invention provides a combined assembly of a fixing base and heat pipes. The fixing base 10 can be made of aluminum, copper or non-metallic materials. The fixing base 10 has a rectangular plate body 11 and two L-shaped extending blocks 12 protruding upwardly and outwardly from both ends of the plate body 11. The bottom surface of the plate body 11 is formed with a plurality of transverse opening troughs 13 that are parallel to one another. Both sides of the opening trough 13 are provided with an upright through-hole 14 respectively that penetrates through the plate body 11. A longitudinal groove 15 is provided in the opening groove 13 at a position corresponding to that of the through-hole 14. The bottom end of the longitudinal groove 15 does not penetrate through the plate body 11 and is formed into a loose-proof section 16 at the bottom section of the opening trough 13. In the present embodiment, the longitudinal grooves are arranged symmetrically, and the loose-proof section 16 is a rectangular block.

Figure 5:
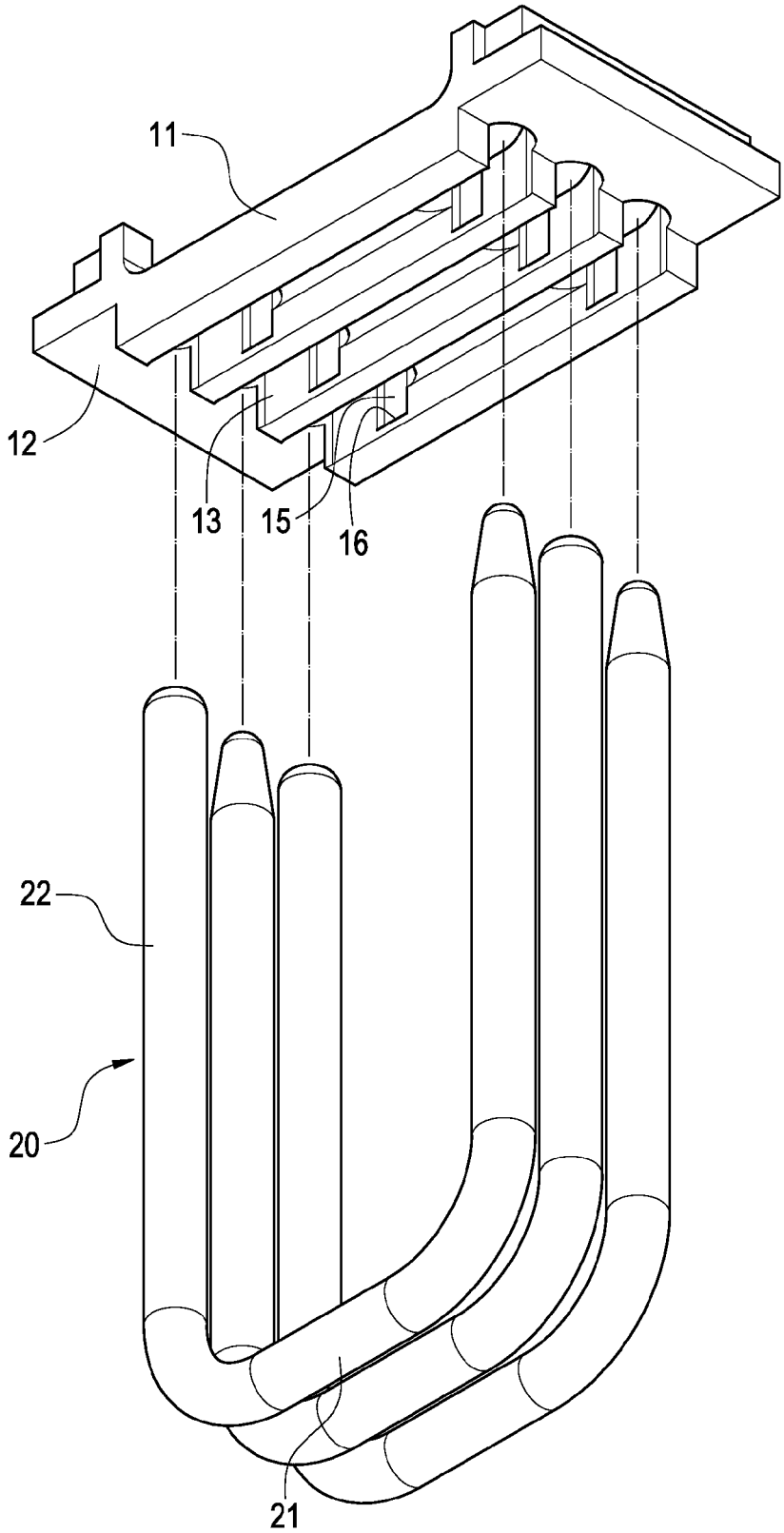
FIG. 5 is an exploded perspective view showing the fixing base and the heat pipes of the present invention.

Please refer to FIG. 5. The fixing base 10 of the present invention is connected and combined with heat pipes 20. Single heat pipe or a plurality of heat pipes 20 may be provided. The number of the heat pipes depends on the desired heat-conducting value. In the present embodiment, there are three heat pipes. The heat pipe 20 may be formed into L-shaped (not shown), U-shaped or other suitable shapes. The heat pipe 20 has a heat-absorbing section 21 and a heat-releasing section 22. The interior of the heat pipe is filled with a capillary structure and a working fluid. Via the heat-transferring mechanism between the vapor phase and the liquid phase of the working fluid, a rapid heat-transferring effect can be achieved.

Figure 6:
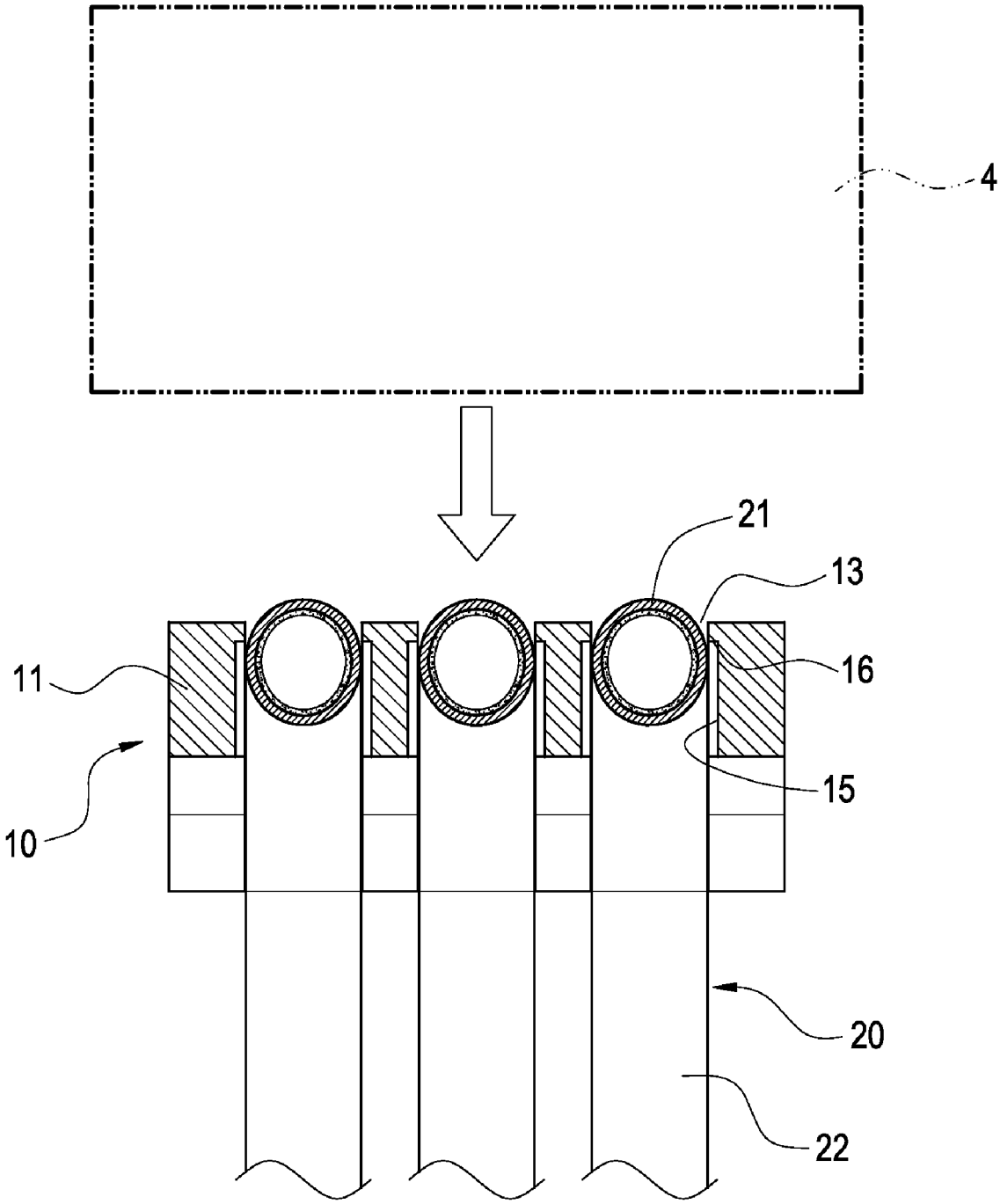
FIG. 6 is a cross-sectional view showing a state before the fixing base and the heat pipes of the present invention are not pressed together.
Figure 7:
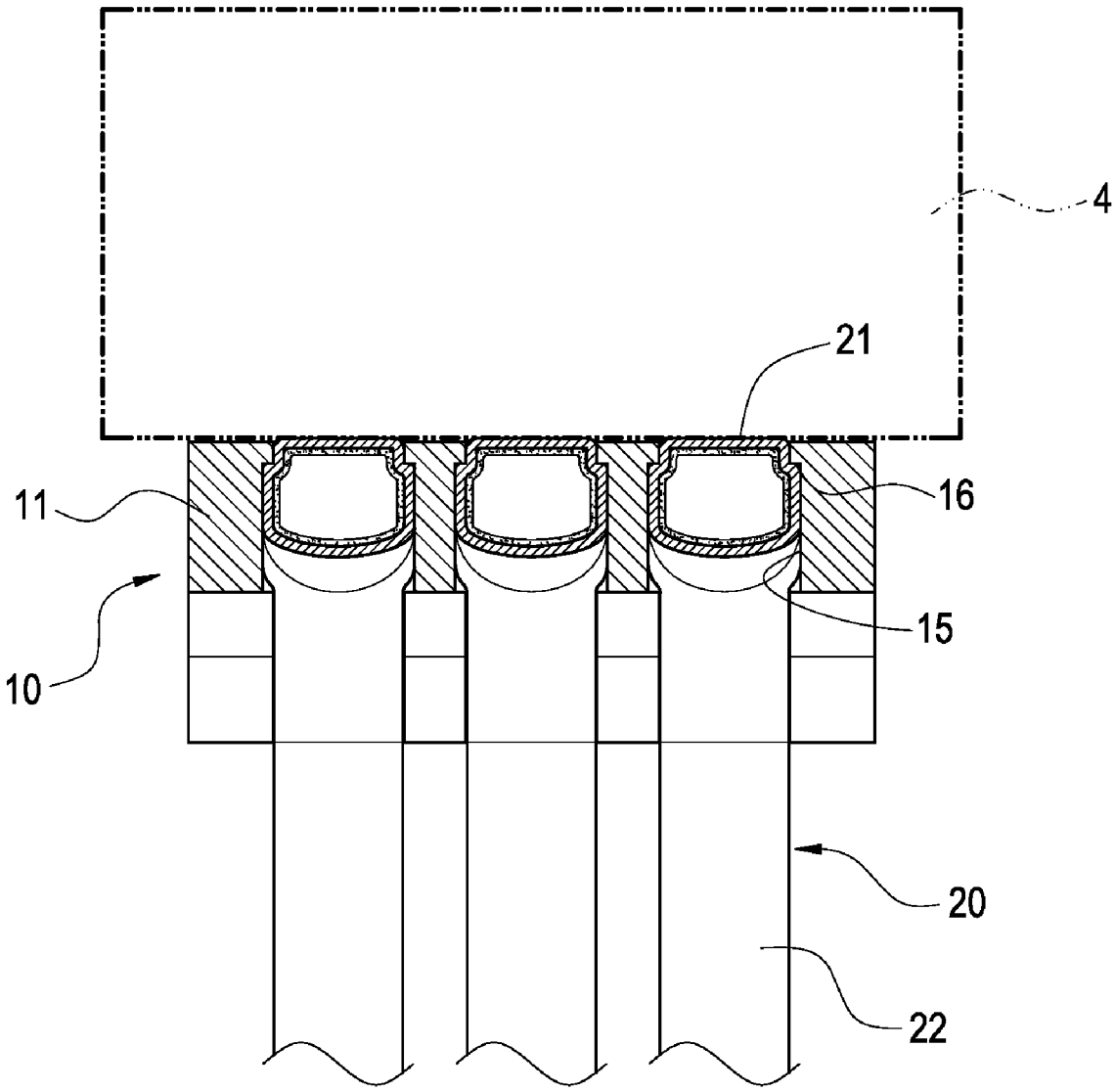
FIG. 7 is a cross-sectional view showing a state after the fixing base and the heat pipes of the present invention have been pressed together.

Please refer to FIGS. 6 and 7. In assembly, the heat-releasing section 22 of the heat pipe 20 penetrates through the outside of the through-hole 14 of the fixing base 10. The lower half portion of the heat-absorbing section 21 is accommodated in the opening trough 13 of the fixing base 10, while its upper half portion is exposed to the outside of the opening trough 13. A pressing tool 4 is used to press the upper half portion of each heat pipe 20. In this way, the external shape of the heat pipe 20 is compressed to deform. A portion of the heat-absorbing section 21 corresponding to the longitudinal groove 15 is inserted into the longitudinal groove 15 by compression. The portion of the heat-absorbing section 21 under the longitudinal groove 15 is bent and deformed along the outer edge of the loose-proof section 16, so that the heat-absorbing section 21 is restricted and stopped by the loose-proof section 16. In this way, the fixing base 10 can be combined with each heat pipe 20 firmly. Further, since the heat-absorbing section 21 is compressed by the pressing tool 4, so that the heat-absorbing section 21 is formed with a plane 211 in flush with the bottom surface 111 of the plate body 11.

Figure 8:
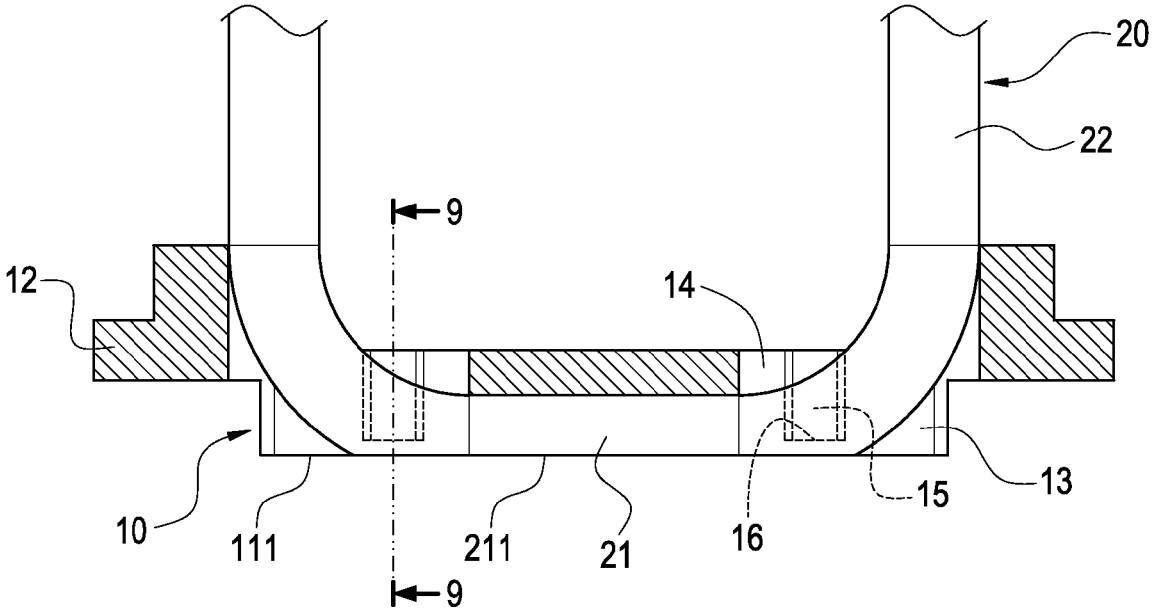
FIG. 8 is a cross-sectional view in another direction showing a state after the fixing base and the heat pipes of the present invention have been pressed together.
Figure 9:
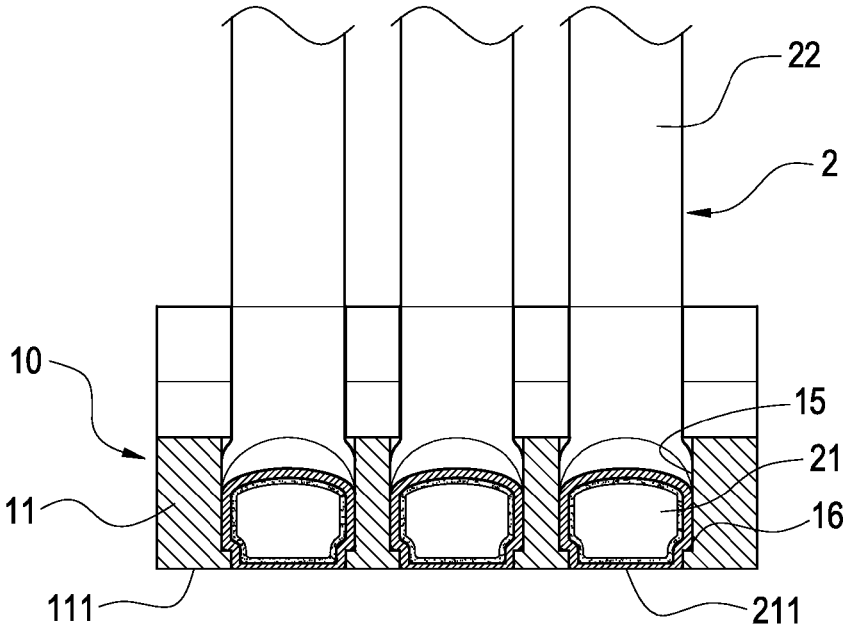
FIG. 9 is a cross-sectional view taken along the line 9-9 in FIG. 8.

Please refer to FIGS. 8 and 9. After the fixing base 10 and each heat pipe 20 are combined with each other completely, a grinding tool (not shown) such as emery cloth or emery wheel is used to grind the plate body 11 and the heat-absorbing section 21 of the heat pipe 20 as a secondary process, so that the plane 211 of the heat-absorbing section 21 is in more flush with the bottom surface 11 of the plate body 11. Via the block-shaped loose-proof section 16 formed under the longitudinal groove 15, the loose-proof section 16 can still hold the heat-absorbing section 21 of the heat pipe 20 tightly even after the fixing base 10 and the heat pipe 20 are ground, thereby preventing the fixing base 10 and the heat pipe 20 from getting loose or detached.

Figure 10:
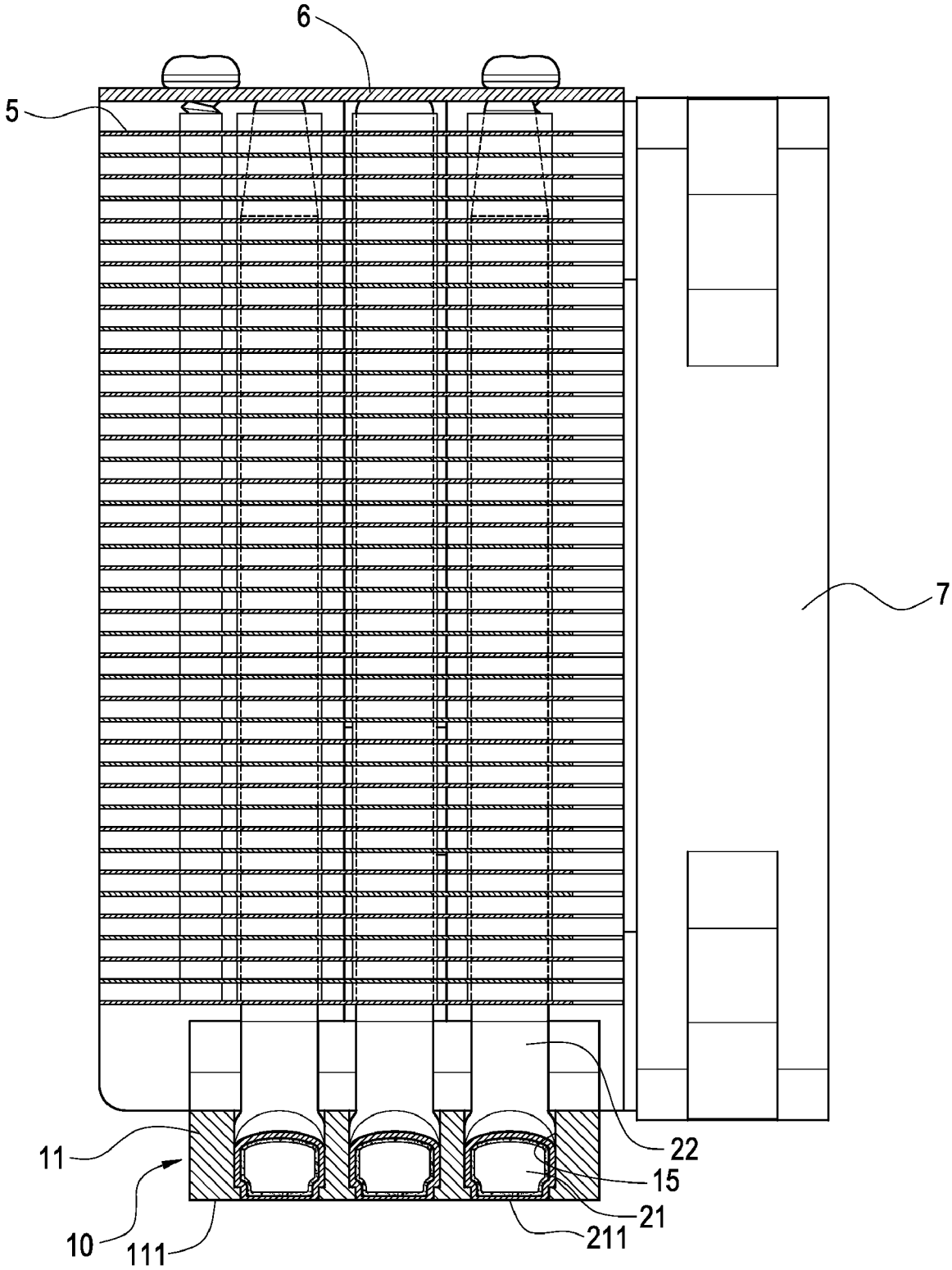
FIG. 10 is a schematic view showing the assembly of the present invention being combined with a heat-dissipating body and a fan.

Please refer to FIG. 10. The combined assembly of the fixing base and the heat pipes according to the present invention can be combined with a plurality of heat-dissipating pieces 5, a mask frame 6 and a fan 7. The heat-releasing section 22 of the heat pipe 20 penetrates each heat-dissipating piece 5 sequentially. Since the fixing base 10 and the heat pipe 20 are combined with each other firmly, the heat pipe 20 may not get loosened or detached due to an axial force even when the heat-dissipating pieces 5 are connecting to the heat pipe 20. Further, the mask frame 6 is fixed to both sides of the fixing base 10 via screws or other fastening elements. The fan 7 is fixed to one side of the mask frame 6 via screws. Thus, with the above arrangement, a heat-dissipating device can be formed.

According to the above, it can be appreciated that the combined assembly of a fixing base and heat pipes in accordance with the present invention indeed has industrial applicability, novelty and inventive steps. Further, the construction of the present invention has not been seen in the products of the same kind or in public use. Therefore, the present invention completely conforms to the requirements for a patent.

What is claimed is:

1. A combined assembly of a fixing base and heat pipes, comprising:

a fixing base (10) having a plate body (11), a bottom surface of the plate body (11) being formed with a transverse opening trough (13), the opening trough being provided with a through-hole (14) that penetrates through the plate body (11), a longitudinal groove (15) being provided in the opening trough 13 at a position corresponding to that of the through-hole (14), one end of the longitudinal groove (15) not penetrating through the plate body (11) and being formed into a loose-proof section (16) on the bottom section of the opening trough (13); and at least one heat pipe (20) having a heat-absorbing section (21) and a heat-releasing section (22), the heat-releasing section (22) penetrating outside the through-hole (14) of the fixing base (10), the heat-absorbing section (21) being accommodated in the opening trough (13), a portion of the heat-absorbing section (21) being inserted into the longitudinal groove (15) and stopped by the loose-proof section (16), the other portion of the heat-absorbing portion being formed with a plane (211) in flush with the bottom surface (111) of the plate body (11).

2. The combined assembly of a fixing base and heat pipes according to claim 1, wherein the fixing base (10) has a rectangular plate body (11) and two extending blocks (12) protruding upwardly and outwardly from both ends of the plate body (11), respectively.

3. The combined assembly of a fixing base and heat pipes according to claim 2, wherein the other end of the longitudinal groove (15) penetrates through the upper surface of the plate body (11).

4. The combined assembly of a fixing base and heat pipes according to claim 1, wherein the loose-proof section (16) is a rectangular block.

5. The combined assembly of a fixing base and heat pipes according to claim 1, wherein the heat pipe (20) is formed into an L-shape.

6. The combined assembly of a fixing base and heat pipes according to claim 1, wherein the heat pipe (20) is formed into a U-shape.

* * * * *